US010073362B2

(12) United States Patent
Fujii et al.

(10) Patent No.: US 10,073,362 B2
(45) Date of Patent: Sep. 11, 2018

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Atsushi Fujii, Yokohama (JP); Haruyuki Tsuji, Yokohama (JP); Hideaki Matsuoka, Mishima (JP); Kazuhisa Shida, Mishima (JP); Nobuhiro Nakamura, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 700 days.

(21) Appl. No.: 14/095,955

(22) Filed: Dec. 3, 2013

(65) Prior Publication Data

US 2014/0093277 A1 Apr. 3, 2014

Related U.S. Application Data

(62) Division of application No. 13/384,852, filed as application No. PCT/JP2010/065569 on Sep. 3, 2010.

(30) Foreign Application Priority Data

| | | |
|---|---|---|
| Sep. 4, 2009 | (JP) | 2009-204522 |
| Jun. 11, 2010 | (JP) | 2010-134306 |
| Sep. 2, 2010 | (JP) | 2010-196408 |

(51) Int. Cl.

| | |
|---|---|
| ***G03G 5/14*** | (2006.01) |
| ***G03G 5/08*** | (2006.01) |
| ***G03G 5/10*** | (2006.01) |

(52) U.S. Cl.
CPC ..... *G03G 5/08* (2013.01); *G03G 5/104* (2013.01); *G03G 5/142* (2013.01); *G03G 5/144* (2013.01)

(58) Field of Classification Search
CPC ..... G03G 5/104; G03G 5/142; G03G 5/10; G03G 5/14704; G03G 5/14791; G03G 5/14708; G03G 5/144
(Continued)

(56) References Cited

U.S. PATENT DOCUMENTS

| | | | |
|---|---|---|---|
| 4,941,022 | A | 7/1990 | Ohmura et al. |
| 5,171,480 | A | 12/1992 | Yoshinaka et al. |

(Continued)

FOREIGN PATENT DOCUMENTS

| | | | |
|---|---|---|---|
| CN | 1462378 | A | 12/2003 |
| CN | 1826665 | A | 8/2006 |

(Continued)

OTHER PUBLICATIONS

PCT International Search Report and Written Opinion of the International Searching Authority, International Application No. PCT/JP2010/065569, dated Dec. 14, 2010.

(Continued)

*Primary Examiner* — Hoa Van Le
(74) *Attorney, Agent, or Firm* — Fitzpatrick Cella Harper and Scinto

(57) ABSTRACT

An electrophotographic photosensitive member that can not easily cause charging lines even where it is an electrophotographic photosensitive member employing as a conductive layer a layer containing metal oxide particles is disclosed. Also disclosed are a process cartridge and an electrophotographic apparatus which have such an electrophotographic photosensitive member. The electrophotographic photosensitive member has a conductive layer which contains tita- (Continued)

nium oxide particles coated with tin oxide doped with phosphorus or tungsten.

5 Claims, 1 Drawing Sheet

(58) Field of Classification Search
USPC ..... 430/63, 65
See application file for complete search history.

(56) References Cited

U.S. PATENT DOCUMENTS

| | | | | |
|---|---|---|---|---|
| 5,357,320 | A | 10/1994 | Kashimura et al. | |
| 5,385,797 | A | 1/1995 | Nagahara et al. | |
| 5,422,210 | A | 6/1995 | Maruyama et al. | |
| 5,455,135 | A | 10/1995 | Maruyama et al. | |
| 5,468,584 | A | 11/1995 | Go et al. | |
| 5,485,250 | A | 1/1996 | Kashimura et al. | |
| 5,488,461 | A | 1/1996 | Go et al. | |
| 5,853,936 | A | 12/1998 | Segi et al. | |
| 6,156,472 | A | 12/2000 | Segi et al. | |
| 6,709,808 | B2 | 3/2004 | Lelental et al. | |
| 6,773,856 | B2 | 8/2004 | Tanaka et al. | |
| 7,211,357 | B2 | 5/2007 | Hosoi et al. | |
| 7,245,851 | B2 | 7/2007 | Fujii et al. | |
| 7,276,318 | B2 | 10/2007 | Fujii et al. | |
| 7,333,752 | B2 | 2/2008 | Kawahara et al. | |
| 7,407,606 | B2 | 8/2008 | Chiba et al. | |
| 7,517,626 | B2 | 4/2009 | Fujii et al. | |
| 7,732,113 | B2 * | 6/2010 | Nakamura et al. | 430/63 |
| 7,910,274 | B2 | 3/2011 | Tanaka et al. | |
| 8,088,541 | B2 | 1/2012 | Tanaka et al. | |
| 8,227,083 | B2 | 7/2012 | Isobe et al. | |
| 8,455,170 | B2 | 6/2013 | Nakamura et al. | |
| 2004/0023139 | A1 | 2/2004 | Yoshimura et al. | |
| 2006/0208228 | A1 | 9/2006 | Chiba et al. | |
| 2009/0136256 | A1 | 5/2009 | Nakamura et al. | |
| 2010/0015538 | A1 * | 1/2010 | Nakamori | 430/56 |
| 2012/0121291 | A1 | 5/2012 | Tsuji et al. | |
| 2013/0316283 | A1 | 11/2013 | Fujii et al. | |
| 2013/0323632 | A1 | 12/2013 | Fujii et al. | |

FOREIGN PATENT DOCUMENTS

| | | | |
|---|---|---|---|
| CN | 101400608 | A | 4/2009 |
| EP | 0 609 511 | A1 | 8/1994 |
| EP | 0 918 259 | A2 | 5/1999 |
| EP | 1 647 583 | A1 | 4/2006 |
| EP | 1 647 997 | A1 | 4/2006 |
| JP | 2-158789 | A | 6/1990 |
| JP | 6-207118 | A | 7/1994 |
| JP | 6-208238 | A | 7/1994 |
| JP | 6-222600 | A | 8/1994 |
| JP | 7-295270 | A | 11/1995 |
| JP | 11-7145 | A | 1/1999 |
| JP | 2003-316059 | A | 11/2003 |
| JP | 2007-47736 | A | 2/2007 |
| JP | 2009-58789 | A | 3/2009 |
| WO | 2005/008685 | A1 | 1/2005 |

OTHER PUBLICATIONS

Chinese Office Action dated Nov. 26, 2012 in Chinese Application No. 201080038986.1.

European Search Report dated May 2, 2013 in European Application No. 10813856.1.

Russian Office Action dated May 8, 2013 in Russian Application No. 2012112931.

European Search Report dated Mar. 31, 2016 in European Application No. 15003356.1.

* cited by examiner

ELECTROPHOTOGRAPHIC PHOTOSENSITIVE MEMBER, PROCESS CARTRIDGE, AND ELECTROPHOTOGRAPHIC APPARATUS

This application is a divisional of application Ser. No. 13/384,852 which was the National Stage of International Application No. PCT/JP2010/065569, filed Sep. 3, 2010.

TECHNICAL FIELD

This invention relates to an electrophotographic photosensitive member, and a process cartridge and an electrophotographic apparatus which have the electrophotographic photosensitive member.

BACKGROUND ART

In recent years, research and development are energetically made on electrophotographic photosensitive members (organic electrophotographic photosensitive members) making use of organic photoconductive materials.

The electrophotographic photosensitive member is basically constituted of a support and a photosensitive layer formed on the support. In the present state of affairs, however, various layers are often formed between the support and the photosensitive layer for the purposes of, e.g., covering any defects of the surface of the support, protecting the photosensitive layer from any electrical breakdown, improving its charging performance, improving the blocking of injection of electric charges from the support into the photosensitive layer, and so forth.

Among such layers formed between the support and the photosensitive layer, a layer containing metal oxide particles is known as the layer formed for the purpose of covering any defects of the surface of the support. The layer containing metal oxide particles commonly has a higher electrical conductivity than a layer not containing any metal oxide particles (e.g., $5.0\times10^{8}$ to $1.0\times10^{13}$ Ω·cm as volume resistivity). Thus, even where it is formed in a large layer thickness, any residual potential at the time of image formation can not easily come to increase, and hence any defects of the support surface can be covered with ease.

The covering of defects of the support surface by providing between the support and the photosensitive layer such a layer having a higher electrical conductivity (hereinafter "conductive layer) makes the support surface have a great tolerance for its defects. As the results, this makes the support have a vastly great tolerance for its use, and hence brings an advantage that the electrophotographic photosensitive member can be improved in productivity.

Patent Literature 1 discloses a technique in which tin oxide particles doped with phosphorus are used in a layer formed between the support and the photosensitive layer. Patent Literature 2 also discloses a technique in which tin oxide particles doped with tungsten are used in a protective layer formed on the photosensitive layer. Patent Literature 3 still also discloses a technique in which titanium oxide particles coated with oxygen deficient tin oxide are used in a conductive layer formed between the support and the photosensitive layer. Patent Literatures 4 and 5 still also disclose a technique in which barium sulfate particles coated with tin oxide are used in a layer formed between the support and the photosensitive layer. Patent Literature 6 still also discloses a technique in which titanium oxide particles coated with indium oxide doped with tin (indium oxide-tin oxide) are used in a layer formed between the support and the photosensitive layer.

CITATION LIST

Patent Literature

PTL 1: Japanese Patent Application Laid-open No. H06-222600

PTL 2: Japanese Patent Application Laid-open No. 2003

PTL 3: Japanese Patent Application Laid-open No. 2007-047736

PTL 4: Japanese Patent Application Laid-open No. H06-208238

PTL 5: Japanese Patent Application Laid-open No. H07-295270

PTL 6: Japanese Patent Application Laid-open No. H11-007145

SUMMARY OF INVENTION

Technical Problem

However, studies made by the present inventors have revealed that charging lines comes to tend to occur in reproduced images when images are formed in a low-temperature and low-humidity environment by using an electrophotographic photosensitive member employing as the conductive layer any layer containing such metal oxide particles as the above. The charging lines refer to line-like faulty images appearing in the direction perpendicular to the peripheral direction of the surface of the electrophotographic photosensitive member, which are caused by a lowering of uniformity in surface potential (i.e., non-uniform charging) of an electrophotographic photosensitive member when the surface of the electrophotographic photosensitive member is electrostatically charged, and tend to remarkably appear when halftone images are reproduced.

An object of the present invention is to provide an electrophotographic photosensitive member that can not easily cause such charging lines even where it is an electrophotographic photosensitive member employing as the conductive layer the layer containing metal oxide particles, and a process cartridge and an electrophotographic apparatus which have such an electrophotographic photosensitive member.

Solution to Problem

The present invention is an electrophotographic photosensitive member which comprises a support, a conductive layer formed on the support, and a photosensitive layer formed on the conductive layer, wherein;

the conductive layer contains a binding material, and titanium oxide particles coated with tin oxide doped with phosphorus or tungsten.

The present invention is also a process cartridge which integrally supports the above electrophotographic photosensitive member and at least one means selected from the group consisting of a charging means, a developing means, a transfer means and a cleaning means, and is detachably mountable to the main body of an electrophotographic apparatus.

The present invention is still also an electrophotographic apparatus which comprises the above electrophotographic photosensitive member, and a charging means, an exposure means, a developing means and a transfer means.

Advantageous Effects of Invention

According to the present invention, it can provide an electrophotographic photosensitive member that can not easily cause charging lines even where it is an electrophotographic photosensitive member employing as the conductive layer the layer containing metal oxide particles, and a process cartridge and an electrophotographic apparatus which have such an electrophotographic photosensitive member.

DESCRIPTION OF EMBODIMENTS

Figure 1:
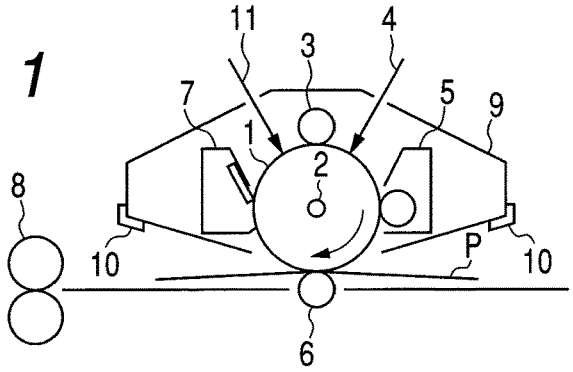
FIG. 1 is a view showing schematically an example of the construction of an electrophotographic apparatus having a process cartridge provided with the electrophotographic photosensitive member of the present invention.

The electrophotographic photosensitive member of the present invention is an electrophotographic photosensitive member having a support, a conductive layer formed on the support, and a photosensitive layer formed on the conductive layer. The photosensitive layer may be a single-layer type photosensitive layer which contains a charge-generating material and a charge-transporting material in a single layer, or may be a multi-layer type photosensitive layer formed in layers of a charge generation layer which contains a charge-generating material and a charge transport layer which contains a charge-transporting material. A subbing layer may also optionally be provided between the conductive layer and the photosensitive layer.

As the support, it may preferably be one having conductivity (a conductive support). For example, a metallic support may be used which is made of a metal, such as aluminum, an aluminum alloy or stainless steel. Where aluminum or an aluminum alloy is used, usable are an aluminum pipe produced by a production process having the step of extrusion and the step of drawing, and an aluminum pipe produced by a production process having the step of extrusion and the step of ironing. Such aluminum pipes can achieve a good dimensional precision and surface smoothness without requiring any surface cutting and besides are advantageous in view of cost as well. However, burr-like protruding defects tend to come on the surfaces of these non-cut aluminum pipes, and hence it is especially effective to provide the conductive layer.

In the present invention, for the purpose of covering any defects of the surface of the support, a conductive layer which contains a binding material and titanium oxide ($TiO_2$) particles coated with tin oxide ($SnO_2$) doped with phosphorus (P) or tungsten (W), is formed on the support. The titanium oxide ($TiO_2$) particles coated with tin oxide ($SnO_2$) doped with phosphorus (P) or tungsten (W) are hereinafter also termed "phosphorus- or tungsten-doped tin oxide coated titanium oxide particles".

The conductive layer may preferably have a volume resistivity of $1.0\times10^{13}$ Ω·cm or less, and much preferably $5.0\times10^{12}$ Ω·cm or less. If a layer having too high volume resistivity is provided on the support as the layer for covering any defects of the surface of the support, the flow of electric charges tends to stagnate therein to tend to increase in residual potential. Also, from the viewpoint of keeping the charging lines from occurring, too, it is preferable for the conductive layer to have a low volume resistivity. The conductive layer may on the other hand preferably have a volume resistivity of $1.0\times10^{8}$ Ω·cm or more, and much preferably $5.0\times10^{8}$ Ω·cm or more. If the conductive layer has too low volume resistivity, the electric charges flowing through the conductive layer may be so large in quantity that dots and/or fog due to the injection of electric charges from the support into the photosensitive layer may tend to occur in reproduced images when images are repeatedly formed in a high-temperature and high-humidity environment.

Figure 2:
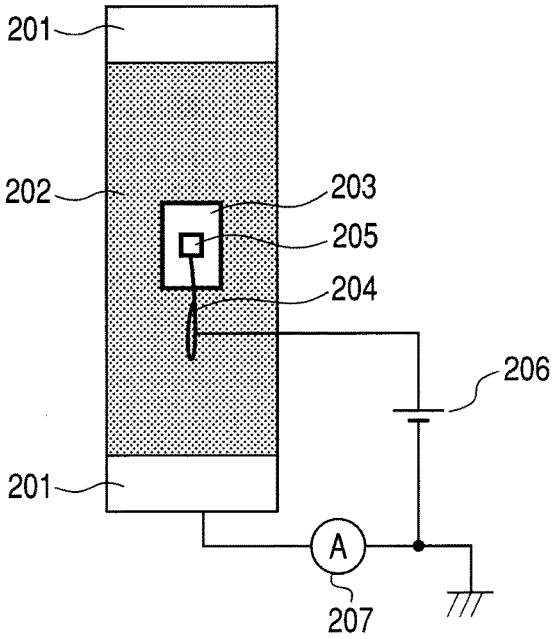
FIG. 2 is a view (plan view) to illustrate how to measure the volume resistivity of a conductive layer.
Figure 3:
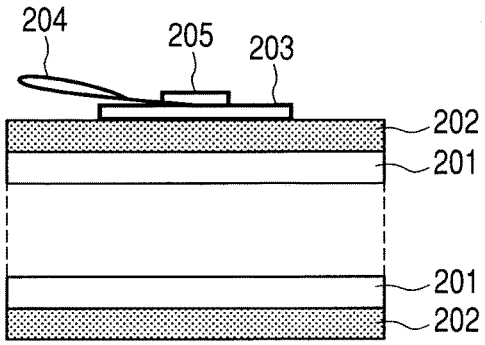
FIG. 3 is a view (sectional view) to illustrate how to measure the volume resistivity of a conductive layer.

How to measure the volume resistivity of the conductive layer of the electrophotographic photosensitive member is described below with reference to FIGS. 2 and 3.

The volume resistivity of the conductive layer is measured in a normal-temperature and normal-humidity (23° C./50% RH) environment. A tape 203 made of copper (Type No. 1181, available from Sumitomo 3M Limited) is stuck to the surface of a conductive layer 202 to make it serve as an electrode on the surface side of the conductive layer 202. A support 201 is also made to serve as an electrode on the back side of the conductive layer 202. A power source 206 and a current measuring instrument 207 are respectively set up; the former for applying voltage across the copper tape 203 and the support 201 and the latter for measuring electric current flowing across the copper tape 203 and the support 201.

To make the voltage applicable to the copper tape 203, a copper wire 204 is put on the copper tape 203, and then a tape 205 made of copper like the copper tape 203 is stuck from above the copper wire 204 to the copper tape 203 so that the copper wire 204 may not protrude from the copper tape 203, to fasten the copper wire 204 to the copper tape 203. To the copper tape 203, voltage is applied through the copper wire 204.

A background current value found when any voltage is not applied across the copper tape 203 and the support 201 is represented by $I_0$ (A), a current value found when a voltage of 1 V having only a direct-current component is applied across the copper tape 203 and the support 201 is represented by I (A), the layer thickness of the conductive layer 202 is represented by d (cm) and the area of the electrode (copper tape 203) on the surface side of the conductive layer 202 is represented by S ($cm^2$), where the value expressed by the following mathematical expression (1) is taken as volume resistivity ρ (Ω·cm) of the conductive layer 202.

$$\rho=1/(I-I_0)\times S/d(\Omega\cdot cm) \quad (1)$$

In this measurement, the level of electric current of extremely as small as $1\times10^{-6}$ A or less is measured, and hence it is preferable to make the measurement by using as the current measuring instrument 207 an instrument that can measure an extremely small electric current. Such an instrument may include, e.g., a pA meter (trade name: 4140B) manufactured by Yokogawa Hewlett-Packard Company.

Incidentally, the volume resistivity of the conductive layer shows the like value in either of measurement made in the state only the conductive layer has been formed on the support or measurement made in the state the respective layers (photosensitive layer and so forth) on the conductive layer have been stripped off the electrophotographic photosensitive member so as to leave only the conductive layer on the support.

In the present invention, composite particles having core particles (titanium oxide ($TiO_2$) particles) and coat layers (phosphorus (P)- or tungsten (W)-doped tin oxide ($SnO_2$) layers) are used as the metal oxide particles to be used in the conductive layer. This is to improve dispersibility of metal oxide particles in a conductive layer coating fluid used in forming the conductive layer. If any phosphorus (P)- or tungsten (W)-doped tin oxide ($SnO_2$) particles (particles composed of only phosphorus (P)- or tungsten (W)-doped tin oxide ($SnO_2$)) are used as the metal oxide particles, the metal oxide particles in the conductive layer coating fluid tend to have a large particle diameter, so that protruding spotty defects may occur on the surface of the conductive layer or the conductive layer coating fluid may become low stable.

The titanium oxide ($TiO_2$) particles are used as the core particles, because their use is highly effective in keeping the charging lines from occurring, and further because such particles have so low transparency as to easily cover any defects on the surface of the support. On the other hand, if, e.g., barium sulfate particles are used as the core particles, this makes it difficult to keep the charging lines from occurring. In addition, because of their high transparency as metal oxide particles, this may additionally require any material for covering the defects on the surface of the support.

Not any uncoated titanium oxide ($TiO_2$) particles, but the phosphorus (P)- or tungsten (W)-doped tin oxide ($SnO_2$) coated titanium oxide ($TiO_2$) particles are used as the metal oxide particles, because such uncoated titanium oxide ($TiO_2$) particles tend to make the flow of electric charges stagnate when images are formed, to tend to result in an increase in residual potential.

In addition, the phosphorus- or tungsten-doped tin oxide coated titanium oxide particles are more highly effective in keeping the charging lines from occurring than titanium oxide ($TiO_2$) particles coated with oxygen deficient tin oxide ($SnO_2$). Further, compared with the titanium oxide ($TiO_2$) particles coated with oxygen deficient tin oxide ($SnO_2$), the former particles are less causative of any increase in volume resistivity in a low-humidity environment and any decrease in volume resistivity in a high-humidity environment, an also have superior environmental stability.

Incidentally, how to produce the phosphorus (P)- or tungsten (W)-doped tin oxide ($SnO_2$) coated titanium oxide ($TiO_2$) particles is also disclosed in Japanese Patent Applications Laid-open No. H06-207118 and No. 2004-349167.

In order for the conductive layer to keep its volume resistivity within the above range, it is preferable to use, in preparing the conductive layer coating fluid used in forming the conductive layer, phosphorus- or tungsten-doped tin oxide coated titanium oxide particles having a powder resistivity of from $1.0\times10^{0}$ Ω·cm or more to $1.0\times10^{6}$ Ω·cm or less. The phosphorus- or tungsten-doped tin oxide coated titanium oxide particles may more preferably have a powder resistivity of from $1.0\times10^{0}$ Ω·cm or more to $1.0\times10^{5}$ Ω·cm or less, much preferably from $1.0\times10^{0}$ Ω·cm or more to $1.0\times10^{3}$ Ω·cm or less, and much more preferably from $1.0\times10^{0}$ Ω·cm or more to $1.0\times10^{2}$ Ω·cm or less. If the phosphorus- or tungsten-doped tin oxide coated titanium oxide particles have too high powder resistivity, it is difficult to control the conductive layer to have the volume resistivity of $1.0\times10^{13}$ Ω·cm or less, or $5.0\times10^{12}$ Ω·cm or less. If on the other hand the phosphorus- or tungsten-doped tin oxide coated titanium oxide particles have too low powder resistivity, the electrophotographic photosensitive member to be produced tends to have a low chargeability.

In the phosphorus- or tungsten-doped tin oxide coated titanium oxide particles, the tin oxide ($SnO_2$) may preferably be in a proportion (coverage) of from 10% by mass to 60% by mass, and much preferably from 15% by mass to 55% by mass. To control the coverage of the tin oxide ($SnO_2$), a tin raw material necessary to form the tin oxide ($SnO_2$) must be compounded when the phosphorus- or tungsten-doped tin oxide coated titanium oxide particles are produced. For example, such compounding must be what has taken account of the tin oxide ($SnO_2$) that is formed from a tin raw material tin chloride ($SnCl_4$). Here, the coverage of the tin oxide ($SnO_2$) is defined to be a value calculated from the mass of tin oxide ($SnO_2$) that is based on the total mass of the tin oxide ($SnO_2$) and the titanium oxide ($TiO_2$), without taking account of the mass of the phosphorus (P) or tungsten (W) with which the tin oxide ($SnO_2$) is doped. Any too small coverage of the tin oxide ($SnO_2$) makes it difficult to control the phosphorus- or tungsten-doped tin oxide coated titanium oxide particles to have the powder resistivity of $1.0\times10^{6}$ Ω·cm or less. Any too large coverage thereof tends to make the titanium oxide ($TiO_2$) particles non-uniformly coated with tin oxide ($SnO_2$), and also tends to result in a high cost.

The phosphorus (P) or tungsten (W) with which the tin oxide ($SnO_2$) is doped (hereinafter also phosphorus or tungsten "doped to tin oxide") may preferably be in an amount (dope level) of from 0.1% by mass to 10% by mass based on the mass of the tin oxide ($SnO_2$) to be doped (the mass not inclusive of that of the phosphorus (P) or tungsten (W)). Any too small dope level of the phosphorus (P) or tungsten (W) with which the tin oxide ($SnO_2$) is doped makes it difficult to control the phosphorus- or tungsten-doped tin oxide coated titanium oxide particles to have the powder resistivity of $1.0\times10^{6}$ Ω·cm or less. Any too large dope level of the phosphorus (P) or tungsten (W) with which the tin oxide ($SnO_2$) is doped makes the tin oxide ($SnO_2$) have a low crystallizability to make it difficult to control the phosphorus- or tungsten-doped tin oxide coated titanium oxide particles to have the powder resistivity of from $1.0\times10^{0}$ Ω·cm or more to $1.0\times10^{6}$ Ω·cm or less. In general, the doping of tin oxide ($SnO_2$) with phosphorus (P) or tungsten (W) can make particles have a low powder resistivity.

The powder resistivity of the phosphorus- or tungsten-doped tin oxide coated titanium oxide particles is measured in a normal-temperature and normal-humidity (23° C./50% RH) environment. In the present invention, a resistance measuring instrument manufactured by Mitsubishi Chemical Corporation (trade name: LORESTA GP) is used as a measuring instrument. The measurement object phosphorus- or tungsten-doped tin oxide coated titanium oxide particles are compacted at a pressure of 500 kg/cm$^2$ to prepare a pellet-shaped measuring sample. The powder resistivity is measured at an applied voltage of 100 V.

In order to more keep the charging lines from occurring, it is preferable for the electrophotographic photosensitive member to have a dielectric loss tan δ at frequency $1.0\times10^{3}$ Hz, of from $5\times10^{-3}$ or more to $2\times10^{-2}$ or less.

About the relationship between the charging lines and the dielectric loss tan δ of the electrophotographic photosensitive member, its details are unclear, and the present inventors consider it as stated below.

In the following, with respect to the direction of rotation of an electrophotographic photosensitive member, this side of a charging region (the region where the surface of the electrophotographic photosensitive member is electrostatically charged by a charging means) is called a charging region upstream side, and its opposite side is called a charging region downstream side. First, after the surface of the electrophotographic photosensitive member has been provided with electric charges on the charging region upstream side, the electric charges come provided in a smaller quantity on the charging region downstream side, so that there may be a case in which areas having been sufficiently charged and areas not having been sufficiently charged are mixedly present on the surface of the electrophotographic photosensitive member. In such a case, a potential difference may come about on the surface of the electrophotographic photosensitive member to come into non-uniform development, where line-like faulty images (tone non-uniformity) may occur in reproduced images in the direction falling at right angles with the peripheral direction of the surface of the electrophotographic photosensitive member. Such faulty images are the charging lines.

As one of the causes of this phenomenon, dielectric polarization is considered. The dielectric polarization is a phenomenon where displacement of electric charges takes place in a dielectric placed into an electric field. One type of this dielectric polarization is the orientation polarization that is caused by changes in direction of dipole moments in any molecules constituting that dielectric.

The relationship between the orientation polarization and the surface potential of the electrophotographic photosensitive member is described below, correlating it with how an electric field changes which has been applied to the electrophotographic photosensitive member when its surface is electrostatically charged.

The surface of the electrophotographic photosensitive member is provided with electric charges on its charging region upstream side, whereupon the electric charges get on the surface of the electrophotographic photosensitive member. While the electric charges get on the surface of the electrophotographic photosensitive member, an electric field is produced by these electric charges (hereinafter called "external electric field"). Because of this external electric field, dipole moments inside the electrophotographic photosensitive member gradually come into polarization (orientation polarization). The sum of vectors of the dipole moments having thus polarized comes to the electric field that has been produced inside the electrophotographic photosensitive member as a result of the polarization (hereinafter called "internal electric field"). With lapse of time, the polarization progresses, and the internal electric field becomes larger.

Next, taking account of the electric field intensity that applies to the whole electrophotographic photosensitive member, and where the electric charges on the surface of the electrophotographic photosensitive member are constant in quantity, the external electric field that such electric charges make up is constant. On the other hand, the internal electric field becomes larger with progress of the orientation polarization. The total sum of electric field intensities applying to the whole electrophotographic photosensitive member may be found by adding the external electric field and the internal electric field, thus it is considered that the total sum of electric field intensities decreases gradually with progress of the polarization.

In the course of progress of orientation polarization, the layer thickness of each layer of the electrophotographic photosensitive member substantially does not change, and hence the potential difference and the electric field are considered to stand a proportional relation, where the total sum of electric field intensities decreasing with progress of the orientation polarization causes a decrease in surface potential of the electrophotographic photosensitive member.

In order to estimate the progress of this orientation polarization, the dielectric loss tan δ is used in the present invention. The dielectric loss tan δ is the heat loss of energy that is based on the progress of orientation polarization in an alternating-current electric field, and serves as an index of time dependency of the orientation polarization. That the dielectric loss tan δ is large at a certain frequency means that the progress of orientation polarization at the time that corresponds to such a frequency is great. The decrease in surface potential of electrophotographic photosensitive member that is caused by the progress of orientation polarization is influenced by how far the orientation polarization progresses during the time (usually about $1.0\times10^{-3}$ second) starting when the surface of the electrophotographic photosensitive member is provided with electric charges on its charging region upstream side and ending when the surface of the electrophotographic photosensitive member is provided with electric charges on its charging region downstream side. If the orientation polarization is not completed during this time, the orientation polarization may inevitably progress before the surface of the electrophotographic photosensitive member is provided with electric charges on its charging region downstream side, and hence the electrophotographic photosensitive member decreases in its surface potential, as so considered.

Thus, it is considered that measuring the dielectric loss tan δ enables prediction of the charging lines, and extent thereof, caused by the decrease in surface potential of electrophotographic photosensitive member that is attended by the progress of orientation polarization.

How to measure the dielectric loss tan δ of the electrophotographic photosensitive member is described below.

First, the electrophotographic photosensitive member is cut along its surface into small pieces (10 mm×10 mm each). Where the electrophotographic photosensitive member is cylindrical, pieces with curved surfaces are each so stretched with a vise or the like as to become planar. On a piece made planar, gold (an electrode) of 600 nm in thickness is vacuum-deposited to prepare a measuring sample. In the present invention, it is vacuum-deposited by means of a sputtering apparatus (trade name: SC-707 QUICK COATER) manufactured by Sanyu Denshi Co., Ltd. This measuring sample is left to stand for 24 hours in a normal-temperature and normal-humidity (23° C./50% RH) environment. After leaving, the dielectric loss tan δ of the electrophotographic photosensitive member measuring sample is measured in the like environment under conditions of a frequency of $1.0\times10^{3}$ Hz and an applied voltage of 100 mV. In the present invention, the dielectric loss tan δ is measured with an impedance analyzer (trade name: Frequency Response Analyzer Model 1260, Dielectric-Constant Interface Model 1296) manufactured by Solartron Co., Ltd.

The measuring sample may also be prepared by forming each layer like that of the measurement object electrophotographic photosensitive member on a support around which an aluminum sheet has been wound, thereafter cutting the aluminum sheet with each layer into small pieces (10 mm×10 mm each), and then vacuum-depositing the gold (an electrode) thereon. Even with use of the measuring sample thus prepared, it shows the like value as above.

The volume resistivity of a conductive layer and the dielectric loss tan δ of the electrophotographic photosensitive member having the conductive layer have a correlation, where the dielectric loss tan δ of the electrophotographic photosensitive member having the conductive layer shows a tendency to increase with an increase in the volume resistivity of the conductive layer.

Where conductive layers have the like volume resistivity, the dielectric loss tan δ of the electrophotographic photosensitive member having the conductive layer containing the phosphorus- or tungsten-doped tin oxide coated titanium oxide particles shows a tendency to come lower than the dielectric loss tan δ of any electrophotographic photosensitive member having a conductive layer containing conventional metal oxide particles. Hence, the use of the phosphorus- or tungsten-doped tin oxide coated titanium oxide particles makes it easy to keep charging lines from occurring while keeping dots and/or fog from occurring.

The conductive layer may be formed by coating a conductive layer coating fluid obtained by dispersing the phosphorus- or tungsten-doped tin oxide coated titanium oxide particles in a solvent together with a binding material, and drying and/or curing the wet coating formed. As a method for dispersion, it may include, e.g., a method making use of a paint shaker, a sand mill, a ball mill or a liquid impact type high-speed dispersion machine.

As the binding material (binder resin) used for the conductive layer, it may include, e.g., phenol resin, polyurethane resin, polyamide resin, polyimide resin, polyamide-imide resin, polyvinyl acetal resin, epoxy resin, acrylic resin, melamine resin, and polyester resin. Any of these may be used alone or in combination of two or more types. Also, of these, from the viewpoints of control of migration (melt-in) to other layers, adhesion to the support, dispersibility and dispersion stability of the phosphorus- or tungsten-doped tin oxide coated titanium oxide particles and solvent resistance after film formation, hardening resins are preferred, and heat-hardening resins (thermosetting resins) are much preferred. Still also, of the thermosetting resins, thermosetting phenol resins and thermosetting polyurethane resins are preferred. Where such a thermosetting resin is used as the binding material for the conductive layer, the binding material to be contained in the conductive layer coating fluid serves as a monomer, and/or an oligomer, of thermosetting resin.

The solvent used in preparing the conductive layer coating fluid may include, e.g., alcohols such as methanol, ethanol and isopropanol; ketones such as acetone, methyl ethyl ketone and cyclohexanone; ethers such as tetrahydrofuran, dioxane, ethylene glycol monomethyl ether and propylene glycol monomethyl ether; esters such as methyl acetate and ethyl acetate; and aromatic hydrocarbons such as toluene and xylene.

In the present invention, the phosphorus- or tungsten-doped tin oxide coated titanium oxide particles (P) and binding material (B) in the conductive layer coating fluid may preferably be in a mass ratio (P/B) of from 1.0/1.0 or more to 3.5/1.0 or less. Any too smaller quantity of the phosphorus- or tungsten-doped tin oxide coated titanium oxide particles than the binding material may make it difficult to control the conductive layer to have the volume resistivity of $1.0\times10^{13}$ Ω·cm or less or $5.0\times10^{12}$ Ω·cm or less. On the other hand, any too larger quantity of the phosphorus- or tungsten-doped tin oxide coated titanium oxide particles than the binding material may make it difficult to control the conductive layer to have the volume resistivity of $1.0\times10^{8}$ Ω·cm or more or $5.0\times10^{8}$ Ω·cm or more. Any too larger quantity of the phosphorus- or tungsten-doped tin oxide coated titanium oxide particles than the binding material may also make it difficult to bind the phosphorus- or tungsten-doped tin oxide coated titanium oxide particles, to tend to cause cracks in the conductive layer.

From the viewpoint of covering any defects of the surface of the support, the conductive layer may preferably have a layer thickness of from 10 μm or more to 40 μm or less, and much preferably from 15 μm or more to 35 μm or less.

In the present invention, the layer thickness of each layer, inclusive of the conductive layer, of the electrophotographic photosensitive member is measured with FISCHERSCOPE Multi Measurement System (mms), available from Fisher Instruments Co.

The phosphorus- or tungsten-doped tin oxide coated titanium oxide particles in the conductive layer coating fluid may preferably have an average particle diameter of from 0.10 μm or more to 0.60 μm or less, and much preferably from 0.15 μm or more to 0.45 μm or less. If the phosphorus- or tungsten-doped tin oxide coated titanium oxide particles have too small average particle diameter, such oxide particles may come to agglomerate again after the conductive layer coating fluid has been prepared, to make the conductive layer coating fluid low stable or cause cracks in the conductive layer. If the phosphorus- or tungsten-doped tin oxide coated titanium oxide particles have too large average particle diameter, the surface of the conductive layer may come so rough as to tend to cause local injection of electric charges therefrom into the photosensitive layer, so that dots may conspicuously appear in white background areas of reproduced images.

The average particle diameter of the phosphorus- or tungsten-doped tin oxide coated titanium oxide particles in the conductive layer coating fluid may be measured by liquid-phase sedimentation in the following way.

First, the conductive layer coating fluid is so diluted with the solvent used in preparing the same, as to have a transmittance between 0.8 and 1.0. Next, a histogram of average particle diameter (volume base D50) and particle size distribution of the phosphorus- or tungsten-doped tin oxide coated titanium oxide particles is prepared by using a centrifugal automatic particle size distribution measuring instrument. In the present invention, as the centrifugal automatic particle size distribution measuring instrument, a centrifugal automatic particle size distribution measuring instrument (trade name: CAPA700) manufactured by Horiba, Ltd. is used to make measurement under conditions of a number of revolutions of 3,000 rpm.

In order to keep interference fringes from appearing on reproduced images because of interference of light having reflected from the surface of the conductive layer, a surface roughness providing material for roughening the surface of the conductive layer may also be added to the conductive layer coating fluid. Such a surface roughness providing material may preferably be resin particles having an average particle diameter of from 1 μm or more to 5 μm or less (preferably 3 μm or less). Such resin particles may include, e.g., particles of hardening rubbers and of hardening resins such as polyurethane, epoxy resin, alkyd resin, phenol resin, polyester, silicone resin and acryl-melamine resin. Of these, particles of silicone resin are preferred as being less agglomerative. The specific gravity of resin particles (which is 0.5 to 2) is smaller than the specific gravity of the phosphorus- or tungsten-doped tin oxide coated titanium oxide particles (which is 4 to 7), and hence the surface of the conductive layer can efficiently be roughened at the time of formation of the conductive layer. However, the conductive layer has a tendency to increase in volume resistivity with an increase in content of the surface roughness providing material in the conductive layer. Hence, in order to control the volume resistivity of the conductive layer to be $1.0\times10^{13}$ Ω·cm or less, the content of the surface roughness providing material in the conductive layer coating fluid may preferably be from 1 to 80% by mass, and much preferably from 1 to 40% by mass, based on the mass of the binding material in the conductive layer coating fluid.

To the conductive layer coating fluid, a leveling agent may also be added in order to enhance the surface properties of the conductive layer. Pigment particles may also be added to the conductive layer coating fluid in order to improve covering properties of the conductive layer.

Between the conductive layer and the photosensitive layer, a subbing layer (also called a barrier layer or an intermediate layer) having electrical barrier properties may be provided in order to block the injection of electric charges from the conductive layer into the photosensitive layer.

The subbing layer may be formed by coating on the conductive layer a subbing layer coating fluid containing a resin (binder resin), and drying the wet coating formed.

The resin (binder resin) used for the subbing layer may include, e.g., water-soluble resins such as polyvinyl alcohol, polyvinyl methyl ether, polyacrylic acids, methyl cellulose, ethyl cellulose, polyglutamic acid, casein, and starch; and polyamide, polyimide, polyamide-imide, polyamic acid, melamine resin, epoxy resin, polyurethane, and polyglutamate. Of these, in order to bring out the electrical barrier properties of the subbing layer effectively, thermoplastic resins are preferred. Of the thermoplastic resins, a thermoplastic polyamide is preferred. As the polyamide, copolymer nylon or the like is preferred.

The subbing layer may preferably have a layer thickness of from 0.1 μm or more to 2 μm or less.

In order to make the flow of electric charges not stagnate in the subbing layer, the subbing layer may also be incorporated with an electron-transporting material.

The photosensitive layer is formed on the conductive layer (a subbing layer).

The charge-generating material used in the photosensitive layer may include, e.g., azo pigments such as monoazo, disazo and trisazo, phthalocyanine pigments such as metal phthalocyanines and metal-free phthalocyanine, indigo pigments such as indigo and thioindigo, perylene pigments such as perylene acid anhydrides and perylene acid imides, polycyclic quinone pigments such as anthraquinone and pyrenequinone, squarilium dyes, pyrylium salts and thiapyrylium salts, triphenylmethane dyes, quinacridone pigments, azulenium salt pigments, cyanine dyes, xanthene dyes, quinoneimine dyes, and styryl dyes. Of these, preferred are metal phthalocyanines such as oxytitanium phthalocyanine, hydroxygallium phthalocyanine and chlorogallium phthalocyanine.

In the case when the photosensitive layer is the multilayer type photosensitive layer, the charge generation layer may be formed by coating a charge generation layer coating fluid obtained by dispersing the charge generating material in a solvent together with a binder resin, and drying the wet coating formed. As a method for dispersion, a method is available which makes use of a homogenizer, ultrasonic waves, a ball mill, a sand mill, an attritor or a roll mill.

The binder resin used to form the charge generation layer may include, e.g., polycarbonate, polyester, polyarylate, butyral resin, polystyrene, polyvinyl acetal, diallyl phthalate resin, acrylic resin, methacrylic resin, vinyl acetate resin, phenol resin, silicone resin, polysulfone, styrene-butadiene copolymer, alkyd resin, epoxy resin, urea resin, and vinyl chloride-vinyl acetate copolymer. Any of these may be used alone or in the form of a mixture or copolymer of two or more types.

The charge generating material and the binder resin may preferably be in a proportion (charge generating material: binder resin) ranging from 10:1 to 1:10 (mass ratio), much preferably from 5:1 to 1:1 (mass ratio), and much more preferably from 3:1 to 1:1 (mass ratio).

The solvent used for the charge generation layer coating fluid may include, e.g., alcohols, sulfoxides, ketones, ethers, esters, aliphatic halogenated hydrocarbons and aromatic compounds.

The charge generation layer may preferably have a layer thickness of 5 μm or less, and much preferably from 0.1 μm or more to 2 μm or less.

To the charge generation layer, a sensitizer, an antioxidant, an ultraviolet absorber, a plasticizer and so forth which may be of various types may also optionally be added. An electron transport material (an electron accepting material such as an acceptor) may also be incorporated in the charge generation layer in order to make the flow of electric charges not stagnate in the charge generation layer.

The charge transporting material used in the photosensitive layer may include, e.g., triarylamine compounds, hydrazone compounds, styryl compounds, stilbene compounds, pyrazoline compounds, oxazole compounds, thiazole compounds, and triarylmethane compounds.

In the case when the photosensitive layer is the multilayer type photosensitive layer, the charge transport layer may be formed by coating a charge transport layer coating fluid obtained by dissolving the charge transporting material and a binder resin in a solvent, and drying the wet coating formed.

The binder resin used to form the charge transport layer may include, e.g., acrylic resin, styrene resin, polyester, polycarbonate, polyarylate, polysulfone, polyphenylene oxide, epoxy resin, polyurethane, alkyd resin and unsaturated resins. Any of these may be used alone or in the form of a mixture or copolymer of two or more types.

The charge transporting material and the binder resin may preferably be in a proportion (charge transporting material: binder resin) ranging from 2:1 to 1:2 (mass ratio).

The solvent used in the charge transport layer coating fluid may include, e.g., ketones such as acetone and methyl ethyl ketone, esters such as methyl acetate and ethyl acetate, ethers such as dimethoxymethane and dimethoxyethane, aromatic hydrocarbons such as toluene and xylene, and hydrocarbons substituted with a halogen atom, such as chlorobenzene, chloroform and carbon tetrachloride.

The charge transport layer may preferably have a layer thickness of from 3 μm or more to 40 μm or less, and much preferably from 5 μm or more to 30 μm or less, from the viewpoint of charging uniformity and image reproducibility.

To the charge transport layer, an antioxidant, an ultraviolet absorber, a plasticizer and so forth may also optionally be added.

In the case when the photosensitive layer is the single-layer type photosensitive layer, the single-layer type photosensitive layer may be formed by coating a single-layer type photosensitive layer coating fluid containing a charge generating material, a charge transporting material, a binder resin and a solvent, and drying the wet coating formed. As these charge generating material, charge transporting material, binder resin and solvent, the above various ones may be used.

For the purpose of protecting the photosensitive layer, a protective layer may also be provided on the photosensitive layer. The protective layer may be formed by coating a protective layer coating fluid containing a resin (binder resin), and drying and/or curing the wet coating formed.

The binder resin used to form the protective layer may include, e.g., phenol resin, acrylic resin, polystyrene, polyester, polycarbonate, polyarylate, polysulfone, polyphenylene oxide, epoxy resin, polyurethane, alkyd resin, siloxane resin and unsaturated resins. Any of these may be used alone or in the form of a mixture or copolymer of two or more types.

The protective layer may preferably have a layer thickness of from 0.5 μm or more to 10 μm or less, and much preferably from 1 μm or more to 8 μm or less.

When the coating fluids for the above respective layers are coated, usable are coating methods as exemplified by dip coating (dipping), spray coating, spinner coating, roller coating, Mayer bar coating and blade coating.

FIG. 1 schematically shows an example of the construction of an electrophotographic apparatus having a process cartridge provided with the electrophotographic photosensitive member of the present invention.

In FIG. 1, reference numeral 1 denotes a drum-shaped electrophotographic photosensitive member, which is rotatingly driven around an axis 2 in the direction of an arrow at a stated peripheral speed.

The peripheral surface of the electrophotographic photosensitive member 1 rotatingly driven is uniformly electrostatically charged to a positive or negative, stated potential through a charging means (primary charging means; e.g., a charging roller) 3. The electrophotographic photosensitive member thus charged is then exposed to exposure light (imagewise exposure light) 4 emitted from an exposure means (an imagewise exposure means; not shown) for slit exposure, laser beam scanning exposure or the like. In this way, electrostatic latent images corresponding to the intended image are successively formed on the peripheral surface of the electrophotographic photosensitive member 1. Voltage to be applied to the charging means 3 may be only direct-current voltage or may be direct-current voltage on which alternating-current voltage is kept superimposed.

The electrostatic latent images thus formed on the peripheral surface of the electrophotographic photosensitive member 1 are developed with a toner of a developing means 5 to form toner images. Then, the toner images thus formed and held on the peripheral surface of the electrophotographic photosensitive member 1 are transferred to a transfer material (such as paper) P by applying a transfer bias from a transfer means (such as a transfer roller) 6. The transfer material P is fed through a transfer material feed means (not shown) to come to the part (contact zone) between the electrophotographic photosensitive member 1 and the transfer means 6 in the manner synchronized with the rotation of the electrophotographic photosensitive member 1.

The transfer material P to which the toner images have been transferred is separated from the peripheral surface of the electrophotographic photosensitive member 1 and is led into a fixing means 8, where the toner images are fixed, and is then put out of the apparatus as an image-formed material (a print or copy).

The peripheral surface of the electrophotographic photosensitive member 1 from which toner images have been transferred is brought to removal of the toner remaining after the transfer, through a cleaning means (such as a cleaning blade) 7. It is further subjected to charge elimination by pre-exposure light 11 emitted from a pre-exposure means (not shown), and thereafter repeatedly used for the formation of images. Incidentally, the pre-exposure is not necessarily required where the charging means is a contact charging means.

The apparatus may be constituted of a combination of plural components integrally joined in a container as a process cartridge from among the constituents such as the above electrophotographic photosensitive member 1, charging means 3, developing means 5, transfer means 6 and cleaning means 7 so that the process cartridge is set detachably mountable to the main body of an electrophotographic apparatus. In what is shown in FIG. 1, the electrophotographic photosensitive member 1 and the charging means 3, developing means 5 and cleaning means 7 are integrally supported to form a cartridge to set up a process cartridge 9 that is detachably mountable to the main body of the electrophotographic apparatus through a guide means 10 such as rails provided in the main body of the electrophotographic apparatus.

In the charging means of process cartridge and electrophotographic apparatus of the present invention, a roller-shaped charging means (charging roller) may preferably be used. As constitution of the charging mean, it may be constituted of, e.g., a conductive substrate and one or more cover layers formed on the conductive substrate. At least one layer of the cover layers is also provided with conductivity. Stated more specifically, as preferable constitution, it may be constituted of a conductive substrate, a conductive elastic layer formed on the conductive substrate and a surface layer formed on the conductive elastic layer.

The charging roller may preferably have a surface of 5.0 μm or less in ten-point average roughness (Rzjis). In the present invention, the ten-point average roughness (Rzjis) of the surface of the charging roller is measured with a surface profile analyzer (trade name: SE-3400) manufactured by Kosaka Laboratory Ltd. More specifically, using this surface profile analyzer, the Rzjis is measured at arbitrary six spots on the surface of the charging roller, and an arithmetic mean value of values found at the six spots is taken as the ten-point average roughness (Rzjis) of the surface of the charging roller.

If the surface of the charging roller has too large ten-point average roughness (Rzjis), the toner and its external additives tend to adhere to the surface of the charging roller, so that faulty images caused by staining of the surface of the charging roller may occur. Also, inasmuch as the surface of the charging roller is controlled to have the ten-point average roughness (Rzjis) of 5.0 μm or less, the difference in discharge level that is due to difference in height of surface profile of the surface of the charging roller can be kept small. Thus, this can keep any faulty images such as dots from occurring because of any faulty charging caused by the profile of the surface of the charging roller.

EXAMPLES

The present invention is described below in greater detail by giving specific working examples. The present invention, however, is by no means limited to these. In the following working examples, "part(s)" refers to "part(s) by mass". Titanium oxide ($TiO_2$) particles (core particles) in the phosphorus- or tungsten-doped tin oxide coated titanium oxide particles as used in the following working examples are all those having a BET value of 6.6 $m^2/g$.

Conductive Layer Coating Fluid Preparation Examples

Preparation Example of Conductive Layer Coating Fluid 1

204 parts of phosphorus (P)-doped tin oxide ($SnO_2$) coated titanium oxide ($TiO_2$) particles (powder resistivity: 40 Ω·cm; coverage of tin oxide ($SnO_2$): 35% by mass; amount of phosphorus (P) doped to tin oxide ($SnO_2$) (phosphorus (P) dope level): 3% by mass) as metal oxide particles, 148 parts of phenol resin (monomer/oligomer of phenol resin) (trade name: PLYOPHEN J-325; available from Dainippon Ink & Chemicals, Incorporated; resin solid content: 60% by mass) as a binder resin and 98 parts of 1-methoxy-2-propanol as a solvent were put into a sand mill making use of 450 parts of glass beads of 0.8 mm in diameter, to carry out dispersion treatment ("dispersing" in Table 1) under conditions of a number of revolutions of 2,000 rpm, a dispersion treatment time of 4 hours and a cooling water preset temperature of 18° C. to obtain a fluid dispersion.

After the glass beads were removed from this fluid dispersion through a mesh, 13.8 parts of silicone resin particles (trade name: TOSPEARL 120; available from GE Toshiba Silicones; average particle diameter: 2 μm) as a surface roughness providing material, 0.014 part of silicone oil (trade name: SH28PA; available from Dow Corning Toray Silicone Co., Ltd.) as a leveling agent, 6 parts of methanol and 6 parts of 1-methoxy-2-propanol were added to the fluid dispersion, followed by stirring to prepare a conductive layer coating fluid 1.

The phosphorus (P)-doped tin oxide ($SnO_2$) coated titanium oxide ($TiO_2$) particles in the conductive layer coating fluid 1 had an average particle diameter of 0.35 μm.

Preparation Examples of Conductive Layer Coating Fluids 2 to 20

Conductive layer coating fluids 2 to 20 were prepared in the same manner as Preparation Example of Conductive Layer Coating Fluid 1 except that the metal oxide particles (phosphorus- or tungsten-doped tin oxide coated titanium oxide particles) used therein in preparing the conductive layer coating fluid were respectively changed as shown in Table 1. The average particle diameters of the metal oxide particles (phosphorus- or tungsten-doped tin oxide coated titanium oxide particles) in the conductive layer coating fluids 2 to 20 are respectively shown in Table 1.

TABLE 1

| | Type and so forth of metal oxide particles (phosphorus- or tungsten-doped tin oxide coated titanium oxide particles) | | | | | | | | Dispersing conditions (sand mill) | |
|---|---|---|---|---|---|---|---|---|---|---|
| | | Coat layers | | | | | Conductive layer coating fluid | | | |
| | | Element doped to tin oxide ($SnO_2$) | | | | | | | | |
| Conductive layer coating fluid | Powder resistivity (Ω · cm) | Material | Type | Dope level (ms. %) | Core particles | Coverage (ms. %) | Amt. of use in preparing (pbm) | Av. particle diam. therein (μm) | Dispersing time (hour) | Number of revolutions (rpm) |
| 1 | 40 | Tin oxide | Phosphorus | 3 | Titanium oxide ($TiO_2$) particles | 35 | 204 | 0.35 | 4 | 2,000 |
| 2 | 150 | | | 3 | | 10 | 204 | 0.37 | 4 | 2,000 |
| 3 | 15 | | | 3 | | 60 | 204 | 0.35 | 4 | 2,000 |
| 4 | 500 | | | 0.05 | | 35 | 204 | 0.34 | 4 | 2,000 |
| 5 | 18 | | | 15 | | 35 | 204 | 0.35 | 4 | 2,000 |
| 6 | 70 | | | 3 | | 15 | 204 | 0.37 | 4 | 2,000 |
| 7 | 30 | | | 3 | | 55 | 204 | 0.34 | 4 | 2,000 |
| 8 | 75 | | | 0.1 | | 35 | 204 | 0.35 | 4 | 2,000 |
| 9 | 25 | | | 10 | | 35 | 204 | 0.35 | 4 | 2,000 |
| 10 | 25 | | Tungsten | 3 | | 33 | 204 | 0.38 | 4 | 2,000 |
| 11 | 60 | | | 3 | | 15 | 204 | 0.40 | 4 | 2,000 |
| 12 | 23 | | | 3 | | 55 | 204 | 0.38 | 4 | 2,000 |
| 13 | 69 | | | 0.1 | | 33 | 204 | 0.38 | 4 | 2,000 |
| 14 | 22 | | | 10 | | 33 | 204 | 0.39 | 4 | 2,000 |
| 15 | 40 | | Phosphorus | 3 | | 35 | 240 | 0.36 | 4 | 2,000 |
| 16 | 40 | | | 3 | | 35 | 133 | 0.34 | 4 | 2,000 |
| 17 | 40 | | | 3 | | 35 | 204 | 0.32 | 8 | 2,000 |
| 18 | 40 | | | 3 | | 35 | 204 | 0.33 | 6 | 2,500 |
| 19 | 40 | | | 3 | | 35 | 266 | 0.37 | 3 | 2,000 |
| 20 | 40 | | | 3 | | 35 | 115 | 0.32 | 10 | 2,000 |

Preparation Example of Conductive Layer Coating Fluid C1

A conductive layer coating fluid C1 was prepared in the same manner as Preparation Example of Conductive Layer Coating Fluid 1 except that 204 parts of the metal oxide particles, phosphorus (P)-doped tin oxide ($SnO_2$) coated titanium oxide ($TiO_2$) particles, used therein in preparing the conductive layer coating fluid were changed for 204 parts of phosphorus (P)-doped tin oxide ($SnO_2$) particles (phosphorus (P)-containing tin oxide ($SnO_2$) particles) disclosed in Example 1 of Japanese Patent Application Laid-open No. H06-222600 (powder resistivity: 25 Ω·cm; amount of phosphorus (P) doped to tin oxide ($SnO_2$) (phosphorus (P) dope level): 1% by mass). The metal oxide particles in the conductive layer coating fluid C1 had an average particle diameter of 0.48 μm.

Preparation Example of Conductive Layer Coating Fluid C2

A conductive layer coating fluid C2 was prepared in the same manner as Preparation Example of Conductive Layer Coating Fluid 1 except that 204 parts of the metal oxide particles, phosphorus (P)-doped tin oxide ($SnO_2$) coated titanium oxide ($TiO_2$) particles, used therein in preparing the conductive layer coating fluid were changed for 204 parts of tungsten (W)-doped tin oxide ($SnO_2$) particles (ultrafine tin oxide ($SnO_2$) particles doped with 7.1 mol % of a tungsten (W) element, based on tin oxide ($SnO_2$)). The metal oxide particles in the conductive layer coating fluid C2 had an average particle diameter of 0.65 μm.

Preparation Example of Conductive Layer Coating Fluid C3

A conductive layer coating fluid C3 was prepared in the same manner as Preparation Example of Conductive Layer Coating Fluid 1 except that 204 parts of the metal oxide particles, phosphorus (P)-doped tin oxide ($SnO_2$) coated titanium oxide ($TiO_2$) particles, used therein in preparing the conductive layer coating fluid were changed for 204 parts of titanium oxide ($TiO_2$) particles coated with oxygen deficient tin oxide ($SnO_2$) as disclosed in Preparation of Conductive Layer Coating Fluid A of Japanese Patent Application Laid-open No. 2007-047736 (oxygen deficient $SnO_2$ coated $TiO_2$ particles) (powder resistivity: 100 Ω·cm; coverage of tin oxide ($SnO_2$): 40% by mass). The metal oxide particles in the conductive layer coating fluid C3 had an average particle diameter of 0.36 μm.

Preparation Example of Conductive Layer Coating Fluid C4

A conductive layer coating fluid C4 was prepared in the same manner as Preparation Example of Conductive Layer Coating Fluid 1 except that 204 parts of the metal oxide particles, phosphorus (P)-doped tin oxide ($SnO_2$) coated titanium oxide ($TiO_2$) particles, used therein in preparing the conductive layer coating fluid were changed for 204 parts of titanium oxide ($TiO_2$) particles coated with antimony (Sb)-doped tin oxide ($SnO_2$) as disclosed in Comparative Example 1 of Japanese Patent Application Laid-open No. H11-007145 (titanium oxide ($TiO_2$) particles having coat layers of antimony oxide-containing tin oxide)(powder resistivity: 200 Ω·cm). The metal oxide particles in the conductive layer coating fluid C4 had an average particle diameter of 0.36 μm.

Preparation Example of Conductive Layer Coating Fluid C5

A conductive layer coating fluid C5 was prepared in the same manner as Preparation Example of Conductive Layer Coating Fluid 1 except that 204 parts of the metal oxide particles, phosphorus (P)-doped tin oxide ($SnO_2$) coated titanium oxide ($TiO_2$) particles, used therein in preparing the conductive layer coating fluid were changed for 204 parts of barium sulfate ($BaSO_4$) particles coated with fluorine (F)-doped tin oxide ($SnO_2$) as disclosed in Example 3 of Japanese Patent Application Laid-open No. H07-295270 (barium sulfate particles having coat layers of fluorine-containing tin oxide) (powder resistivity: 40 Ω·cm; coverage of tin oxide ($SnO_2$): 50% by mass; amount of fluorine (F) doped to tin oxide ($SnO_2$) (fluorine (F) dope level): 9% by mass). The metal oxide particles in the conductive layer coating fluid C5 had an average particle diameter of 0.47 μm.

Preparation Example of Conductive Layer Coating Fluid C6

A conductive layer coating fluid C6 was prepared in the same manner as Preparation Example of Conductive Layer Coating Fluid 1 except that 204 parts of the metal oxide particles, phosphorus (P)-doped tin oxide ($SnO_2$) coated titanium oxide ($TiO_2$) particles, used therein in preparing the conductive layer coating fluid were changed for 240 parts of titanium oxide ($TiO_2$) particles coated with oxygen deficient tin oxide ($SnO_2$) as disclosed in Preparation of Conductive Layer Coating Fluid A of Japanese Patent Application Laid-open No. 2007-047736 (oxygen deficient $SnO_2$ coated $TiO_2$ particles) (powder resistivity: 100 Ω·cm; coverage of tin oxide: 40% by mass). The metal oxide particles in the conductive layer coating fluid C6 had an average particle diameter of 0.36 μm.

Preparation Example of Conductive Layer Coating Fluid C7

A conductive layer coating fluid C7 was prepared in the same manner as Preparation Example of Conductive Layer Coating Fluid 1 except that 204 parts of the metal oxide particles, phosphorus (P)-doped tin oxide ($SnO_2$) coated titanium oxide ($TiO_2$) particles, used therein in preparing the conductive layer coating fluid were changed for 204 parts of phosphorus (P)-doped tin oxide ($SnO_2$) coated barium sulfate ($BaSO_4$) particles (powder resistivity: 40 Ω·cm; coverage of tin oxide: 35% by mass; amount of phosphorus (P) doped to tin oxide ($SnO_2$) (phosphorus (P) dope level): 3% by mass). The metal oxide particles in the conductive layer coating fluid C7 had an average particle diameter of 0.40 μm.

Electrophotographic Photosensitive Member Production Examples

Production Example of Electrophotographic Photosensitive Member 1

An aluminum cylinder (JIS A3003, aluminum alloy) of 246 mm in length and 24 mm in diameter which was produced by a production process having the step of extrusion and the step of drawing was used as a support.

The conductive layer coating fluid 1 was dip-coated on the support in a 23° C./60% RH environment, and then the wet coating formed was dried and heat-cured at 140° C. for 30 minutes to form a conductive layer with a layer thickness of 30 μm. The volume resistivity of the conductive layer was measured by the method described previously, to find that it was $2.1\times10^9$ Ω·cm.

Next, 4.5 parts of N-methoxymethylated nylon (trade name: TORESIN EF-30T; available from Teikoku Chemical Industry Co., Ltd.) and 1.5 parts of copolymer nylon resin (trade name: AMILAN CM8000; available from Toray Industries, Inc.) were dissolved in a mixed solvent of 65 parts of methanol and 30 parts of n-butanol to prepare a subbing layer coating fluid. This subbing layer coating fluid obtained was dip-coated on the conductive layer, and then the wet coating formed was dried at 70° C. for 6 minutes to form a subbing layer with a layer thickness of 0.85 μm.

Next, 10 parts of hydroxygallium phthalocyanine crystals (charge-generating material) with a crystal form having intense peaks at 7.5°, 9.9°, 16.3°, 18.6°, 25.1° and 28.3° of the Bragg's angle 2θ±0.2° in CuKα characteristic X-ray diffraction, 5 parts of polyvinyl butyral resin (trade name:

S-LEC BX-1; available from Sekisui Chemical Co., Ltd.) and 250 parts of cyclohexanone were put into a sand mill making use of glass beads of 0.8 mm in diameter, and put to dispersion treatment under conditions of a dispersion treatment time of 3 hours. Next, to the resultant system, 250 parts of ethyl acetate was added to prepare a charge generation layer coating fluid. This charge generation layer coating fluid was dip-coated on the subbing layer, and then the wet coating formed was dried at 100° C. for 10 minutes to form a charge generation layer with a layer thickness of 0.12 μm.

Next, 4.8 parts of an amine compound (charge-transporting material) represented by the following formula (CT-1) and 3.2 parts of an amine compound (charge-transporting material) represented by the following formula (CT-2):

(CT-1)

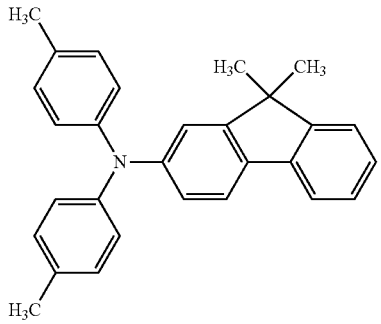

(CT-2)

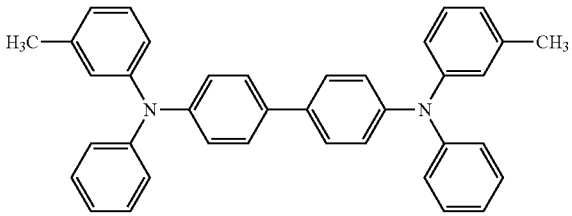

and 10 parts of polycarbonate resin (trade name: Z400; available from Mitsubishi Engineering-Plastics Corporation) were dissolved in a mixed solvent of 30 parts of dimethoxymethane and 70 parts of chlorobenzene to prepare a charge transport layer coating fluid. This charge transport layer coating fluid was dip-coated on the charge generation layer, and then the wet coating formed was dried at 110° C. for 30 minutes to form a charge transport layer with a layer thickness of 12 μm.

Thus, an electrophotographic photosensitive member 1 was produced the charge transport layer of which was a surface layer.

The dielectric loss tan δ at frequency $1.0\times10^3$ Hz, of the electrophotographic photosensitive member 1 was measured by the method described previously, to find that it was $7\times10^{-3}$.

Production Examples of Electrophotographic Photosensitive Members 2 to 20 & C1 to C7

Electrophotographic photosensitive members 2 to 20 and C1 to C7 the charge transport layers of which were surface layers were produced in the same manner as Production Example of Electrophotographic Photosensitive Member 1 except that the conductive layer coating fluid 1 used in producing the electrophotographic photosensitive member was changed for the conductive layer coating fluids 2 to 20 and C1 to C7, respectively. The dielectric loss tan δ at frequency $1.0\times10^3$ Hz, of the electrophotographic photosensitive members 2 to 20 and C1 to C7 each was measured like the electrophotographic photosensitive member 1 by the method described previously. In regard to the volume resistivity of the conductive layer of the electrophotographic photosensitive members 2 to 20 and C1 to C7 each, too, it was measured like the electrophotographic photosensitive member 1 by the method described previously. Results obtained thereon are shown in Table 2.

Production Example of Electrophotographic Photosensitive Member 21

An electrophotographic photosensitive member 21 the charge transport layer of which was a surface layer was produced in the same manner as Production Example of Electrophotographic Photosensitive Member 1 except that 10 parts of the charge-generating material, hydroxygallium phthalocyanine crystals with a crystal form having intense peaks at 7.5°, 9.9°, 16.3°, 18.6°, 25.1° and 28.3° of the Bragg's angle 2θ±0.2° in CuKα characteristic X-ray diffraction, was changed for 10 parts of oxytitanium phthalocyanine crystals with a crystal form having intense peaks at 9.0°, 14.2°, 17.9°, 23.9° and 27.1° of the Bragg's angle 2θ±0.2° in CuKα characteristic X-ray diffraction. The dielectric loss tan δ at frequency $1.0\times10^3$ Hz, of the electrophotographic photosensitive member 21 and the volume resistivity of its conductive layer were measured like the electrophotographic photosensitive member 1 by the methods described previously. Results obtained thereon are shown in Table 2.

Production Example of Electrophotographic Photosensitive Member 22

An electrophotographic photosensitive member 22 was produced in the same manner as Production Example of Electrophotographic Photosensitive Member 1 except that the amount 4.8 parts of the amine compound represented by the structural formula (CT-1), used in forming the charge transport layer of the electrophotographic photosensitive member, was changed to 7 parts and also that 3.2 parts of the amine compound represented by the formula (CT-2), also used therein, was changed for 1 part of an amine compound represented by the following formula (CT-3):

(CT-3)

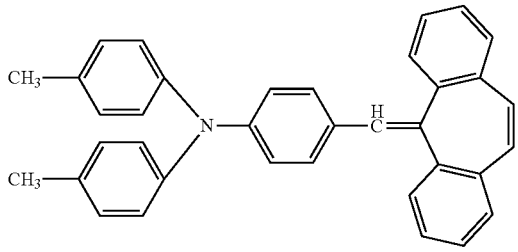

The dielectric loss tan at frequency $1.0\times10^3$ Hz, of the electrophotographic photosensitive member 22 and the volume resistivity of its conductive layer were measured like the electrophotographic photosensitive member 1 by the methods described previously. Results obtained thereon are shown in Table 2.

Production Example of Electrophotographic Photosensitive Member R1

An electrophotographic photosensitive member R1 was produced in the same manner as Production Example of Electrophotographic Photosensitive Member 1 except that the conductive layer was not formed in producing the electrophotographic photosensitive member. The dielectric loss tan at frequency $1.0\times10^3$ Hz, of the electrophotographic photosensitive member R1 was measured like the electrophotographic photosensitive member 1 by the method described previously. Results obtained thereon are shown in Table 2.

TABLE 2

| Electrophotographic photosensitive member | Conductive layer coating fluid | Dielectric loss tanδ at frequency $1.0 \times 10^3$ Hz, of electrophotographic photosensitive member | Volume resistivity of conductive layer (Ω · cm) |
|---|---|---|---|
| 1 | 1 | $7 \times 10^{-3}$ | $2.1 \times 10^9$ |
| 2 | 2 | $8 \times 10^{-3}$ | $6.5 \times 10^9$ |
| 3 | 3 | $6 \times 10^{-3}$ | $8.8 \times 10^8$ |
| 4 | 4 | $7 \times 10^{-3}$ | $3.1 \times 10^9$ |
| 5 | 5 | $6 \times 10^{-3}$ | $1.5 \times 10^9$ |
| 6 | 6 | $8 \times 10^{-3}$ | $5.7 \times 10^9$ |
| 7 | 7 | $6 \times 10^{-3}$ | $9.6 \times 10^8$ |
| 8 | 8 | $7 \times 10^{-3}$ | $2.3 \times 10^9$ |
| 9 | 9 | $6 \times 10^{-3}$ | $1.8 \times 10^9$ |
| 10 | 10 | $3 \times 10^{-2}$ | $4.0 \times 10^9$ |
| 11 | 11 | $1 \times 10^{-1}$ | $1.2 \times 10^{10}$ |
| 12 | 12 | $8 \times 10^{-3}$ | $1.0 \times 10^9$ |
| 13 | 13 | $5 \times 10^{-2}$ | $5.8 \times 10^9$ |
| 14 | 14 | $3 \times 10^{-2}$ | $3.2 \times 10^9$ |
| 15 | 15 | $5 \times 10^{-3}$ | $5.0 \times 10^8$ |
| 16 | 16 | $4 \times 10^{-2}$ | $1.0 \times 10^{13}$ |
| 17 | 17 | $2 \times 10^{-2}$ | $2.3 \times 10^{10}$ |
| 18 | 18 | $2 \times 10^{-2}$ | $6.5 \times 10^{10}$ |
| 19 | 19 | $4 \times 10^{-3}$ | $1.2 \times 10^8$ |
| 20 | 20 | $7 \times 10^{-2}$ | $6.0 \times 10^{13}$ |
| 21 | 1 | $7 \times 10^{-3}$ | $2.1 \times 10^9$ |
| 22 | 1 | $7 \times 10^{-3}$ | $2.1 \times 10^9$ |
| R1 | — | $5 \times 10^{-3}$ | — |
| C1 | C1 | $4 \times 10^{-2}$ | $3.5 \times 10^9$ |
| C2 | C2 | $4 \times 10^{-2}$ | $4.2 \times 10^9$ |
| C3 | C3 | $2 \times 10^{-2}$ | $5.0 \times 10^9$ |
| C4 | C4 | $3 \times 10^{-2}$ | $1.3 \times 10^{10}$ |
| C5 | C5 | $5 \times 10^{-2}$ | $3.2 \times 10^{10}$ |
| C6 | C6 | $2 \times 10^{-2}$ | $5.0 \times 10^8$ |
| C7 | C7 | $2 \times 10^{-2}$ | $2.1 \times 10^9$ |

Examples 1 to 22, Reference Examples 1 & Comparative Examples 1 to 7

Electrophotographic photosensitive members 1 to 22, R1 and C1 to C7 were each set in a laser beam printer (trade name: HP LASERJET P1505) manufactured by Hewlett-Packard Co., and a paper feed running test was conducted in a low-temperature and low-humidity (15° C./10% RH) environment to make image evaluation. In the paper feed running test, printing was operated in an intermittent mode in which a character image with a print percentage of 2% was sheet by sheet reproduced on letter paper, to reproduce images on 3,000 sheets.

Then, samples for image evaluation were reproduced on two sheets (solid white images, and one-dot keima (similar to knight's move) pattern halftone images) at the start of the running test and after the finish of image reproduction on 3,000-sheet running.

The image evaluation was made on charging lines and on dots (black dots) and/or fog. The evaluation on charging lines was made by using the one-dot keima (similar to knight's move) pattern halftone images. Criteria therefor are as show below.

A: No charging line is seen at all.

B: Charging lines are almost not seen.

C: Charging lines are slightly seen.

D: Charging lines are seen.

E: Charging lines are clearly seen.

The evaluation on black dots and/or fog was made by using the solid white images. Results obtained are shown in Table 3.

In addition to the electrophotographic photosensitive members 1 to 22, R1 and C1 to C7 on which the above paper feed running test was conducted, another one for each of the electrophotographic photosensitive members 1 to 22, R1 and C1 to C7 was also readied, and the same paper feed running test as the above was conducted thereon in a high-temperature and high-humidity (30° C./80% RH) environment to make image evaluation on those other than the charging lines. Results obtained are shown together in Table 3.

TABLE 3

| | | Low-temperature/low-humidity environment (15° C./10% RH) | | | |
|---|---|---|---|---|---|
| | | Charging lines | | | |
| | Electrophotographic photosensitive member | At start of running test | After 3,000-sheet image reproductn | Black dots and/or fog | High-temperature/high-humidity environment (30° C./80% RH) Black dots and/or fog |
| Example: | | | | | |
| 1 | 1 | A | A | Fog and black dots do not occur. | Fog and black dots do not occur. |
| 2 | 2 | A | B | Fog and black dots do not occur. | Fog and black dots do not occur. |
| 3 | 3 | A | A | Black dots occur slightly in images after 3,000-sheet image reproduction. | Fog and black dots do not occur. |
| 4 | 4 | A | B | Fog and black dots do not occur. | Fog and black dots do not occur. |
| 5 | 5 | A | A | Black dots occur slightly in images after 3,000-sheet image reproduction. | Fog and black dots do not occur. |
| 6 | 6 | A | A | Fog and black dots do not occur. | Fog and black dots do not occur. |
| 7 | 7 | A | A | Fog and black dots do not occur. | Fog and black dots do not occur. |
| 8 | 8 | A | A | Fog and black dots do not occur. | Fog and black dots do not occur. |
| 9 | 9 | A | A | Fog and black dots do not occur. | Fog and black dots do not occur. |

TABLE 3-continued

| | | Low-temperature/low-humidity environment (15° C./10% RH) | | | |
|---|---|---|---|---|---|
| | | Charging lines | | | |
| | Electro-photographic photo-sensitive member | At start of running test | After 3,000-sheet image reproductn | Black dots and/or fog | High-temperature/high-humidity environment (30° C./80% RH) Black dots and/or fog |
| 10 | 10 | B | B | Fog and black dots do not occur. | Fog and black dots do not occur. |
| 11 | 11 | B | B | Fog and black dots do not occur. | Fog and black dots do not occur. |
| 12 | 12 | A | A | Fog and black dots do not occur. | Fog and black dots do not occur. |
| 13 | 13 | B | B | Fog and black dots do not occur. | Fog and black dots do not occur. |
| 14 | 14 | B | B | Fog and black dots do not occur. | Fog and black dots do not occur. |
| 15 | 15 | A | A | Fog and black dots do not occur. | Fog and black dots do not occur. |
| 16 | 16 | B | B | Fog and black dots do not occur. | Fog and black dots do not occur. |
| 17 | 17 | A | A | Fog and black dots do not occur. | Fog and black dots do not occur. |
| 18 | 18 | A | B | Fog and black dots do not occur. | Fog and black dots do not occur. |
| 19 | 19 | A | A | Fog and black dots do not occur. | Black dots occur slightly in images at start of running test and after 3,000-sheet image reproduction. |
| 20 | 20 | B | B | Fog and black dots do not occur. | Fog and black dots do not occur. |
| 21 | 21 | A | A | Fog and black dots do not occur. | Fog and black dots do not occur. |
| 22 | 22 | A | A | Fog and black dots do not occur. | Fog and black dots do not occur. |
| Reference Example: | | | | | |
| 1 | R1 | A | A | Fog and black dots occur greatly in images at start of running test and after 3,000-sheet image reproduction. | Fog and black dots occur greatly in images at start of running test and after 3,000-sheet image reproduction. |
| Comparative Example: | | | | | |
| 1 | C1 | D | D | Fog and black dots occur in images at start of running test and after 3,000-sheet image reproduction. | Fog and black dots occur in images at start of running test and after 3,000-sheet image reproduction. |
| 2 | C2 | D | E | Fog and black dots occur in images at start of running test and after 3,000-sheet image reproduction. | Fog and black dots occur in images at start of running test and after 3,000-sheet image reproduction. |
| 3 | C3 | C | D | Fog and black dots do not occur. | Fog and black dots do not occur. |
| 4 | C4 | C | C | Fog and black dots occur slightly in images at start of running test and after 3,000-sheet image reproduction. | Fog and black dots occur slightly in images at start of running test and after 3,000-sheet image reproduction. |
| 5 | C5 | E | E | Fog occurs in images at start of running test. | Fog occurs in images after 3,000-sheet image reproduction. |
| 6 | C6 | B | C | Black dots occur slightly in images at start of running test and after 3,000-sheet image reproduction. | Black dots occur in images at start of running test and after 3,000-sheet image reproduction. |
| 7 | C7 | C | C | Fog and black dots occur slightly in images at start of running test and after 3,000-sheet image reproduction. | Fog and black dots occur slightly in images at start of running test and after 3,000-sheet image reproduction. |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-204522, filed Sep. 4, 2009, No. 2010-134306, filed Jun. 11, 2010 and No. 2010-196408, filed Sep. 2, 2010, which are hereby incorporated by reference herein in their entirety.

The invention claimed is:

1. An electrophotographic photosensitive member comprising:

a support;

a conductive layer formed on the support; and a photosensitive layer formed on the conductive layer, wherein the conductive layer contains a binding material, and titanium oxide particles coated with tin oxide doped with phosphorus, and wherein a dielectric loss tanδ of the electrophotographic photosensitive member at a frequency of $1.0\times10^{3}$ Hz is from $5\times10^{-3}$ or more to $2\times10^{-2}$ or less.

2. The electrophotographic photosensitive member according to claim 1, wherein the conductive layer has a volume resistivity of from $5.0\times10^{8}$ Ω·cm or more to $1.0\times10^{13}$ Ω·cm or less.

3. A process cartridge which integrally supports the electrophotographic photosensitive member according to claim

1 and at least one means selected from the group consisting of a charging means, a developing means, a transfer means and a cleaning means, and is detachably mountable to the main body of an electrophotographic apparatus.

4. An electrophotographic apparatus which comprises the electrophotographic photosensitive member according to claim 1, and a charging means, an exposure means, a developing means and a transfer means.

5. The electrophotographic photosensitive member according to claim 1, wherein the conductive layer has a volume resistivity of from $5.0\times10^{8}$ Ω·cm or more to $5.0\times10^{12}$ Ω·cm or less.

* * * * *